US006907218B2

(12) United States Patent
Fujiwara et al.

(10) Patent No.: US 6,907,218 B2
(45) Date of Patent: Jun. 14, 2005

(54) IMAGE FORMING DEVICE AND COMMUNICATION DEVICE

(75) Inventors: Hidehiko Fujiwara, Tokyo (JP); Masahiko Kamijoh, Kanagawa-Ken (JP); Kohta Takenaka, Kanagawa-Ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/255,929

(22) Filed: Sep. 27, 2002

(65) Prior Publication Data

US 2003/0063933 A1 Apr. 3, 2003

(30) Foreign Application Priority Data

Sep. 28, 2001 (JP) ..... 2001-299276

(51) Int. Cl.[7] ..... G03G 15/20
(52) U.S. Cl. ..... 399/322; 399/328
(58) Field of Search ..... 399/320, 322, 399/328, 397, 400; 347/156

(56) References Cited

U.S. PATENT DOCUMENTS 5,070,373 A * 12/1991 Fukano et al. ..... 399/322
5,177,544 A * 1/1993 Kimura et al. ..... 399/16
5,528,351 A * 6/1996 Tsuji ..... 399/322
5,592,277 A * 1/1997 Kusaka et al. ..... 399/328
5,671,474 A * 9/1997 Fukano ..... 399/328 X
5,708,947 A * 1/1998 Kagawa et al. ..... 399/328
5,715,507 A * 2/1998 Kobayashi et al. ..... 399/328
5,790,931 A * 8/1998 Tsuji et al. ..... 399/328
5,809,389 A * 9/1998 Tamura et al. ..... 399/322
6,070,046 A * 5/2000 Maeyama ..... 399/328
6,205,297 B1 * 3/2001 Tachibana et al. ..... 399/322 X
6,564,032 B2 * 5/2003 Hara et al. ..... 399/328

FOREIGN PATENT DOCUMENTS

JP 9-179428 7/1997
JP 10-232570 9/1998

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image forming device comprises a fixing device that is composed of a fixing roller and a sheet-shaped pressure unit. The position of the fixing nip portion is set above a plane containing a transporting direction of the recording paper at the transferring nip portion. A recording paper guider is further disposed for guiding the recording paper transported by the transferring roller to the fixing roller. The guiding surface of the recording paper guider is inclined and gradually raised beginning at the transferring roller side (as the lowest position).

13 Claims, 9 Drawing Sheets

IMAGE FORMING DEVICE AND COMMUNICATION DEVICE

CROSS-REFERENCE TO RELATED APPLICATION

This application claims the priority benefit of Japanese application serial No. 2001-299276, filed on Sep. 28, 2001.

BACKGROUND OF THE INVENTION

1. Field of the Invention

This invention relates in general to an image forming device. More particularly, the invention relates to an image forming device of electronic photographic type, wherein the image forming device comprises a fixing device that uses a sheet unit to press a fixing roller, and is suitable for a facsimile device, a printer, a copy machine or a multi-function machine with the above functions.

2. Description of Related Art

FIG. 9 is a side view showing an internal structure of a conventional fixing device. The fixing device comprises a fixing roller 50, a pressure roller 51 pressed to be in contact with the fixing roller 50, a fixing heater 52 arranged inside the fixing roller 50 for heating the fixing roller 50, a temperature detecting device 53 for detecting the fixing roller 50's temperature, a separating claw 54 for separating a recording paper attached on the fixing roller 50 from the fixing roller 50, a cleaning pad 55 in contact with the fixing roller 50 for cleaning the fixing roller 50, a cleaning pad holder 56 for supporting the cleaning pad 55, a cleaning pad invasion regulating unit 57 installed at a downstream side of the fixing roller 50's rotational direction with respect to the cleaning pad 55, an entrance guiding plate 58 installed at an entrance of the recording paper in the fixing device's main body, an ejecting roller 59 installed at an exit of the recording paper of the fixing device, and a driven ejecting roller 60 that is driven by being in contact with the ejecting roller 59.

The recording paper where the toner image has been transferred thereon enters a nip portion between the fixing roller 50 and the pressure roller 51 through the entrance guiding plate 58. After the toner image is fixed onto the recording paper by heating and pressing at the nip portion, the recording paper is ejected to an external tray through the ejecting roller 59. As the recording paper passes through the nip portion, the toner adhered on the fixing roller 50 is removed by the cleaning pad 55.

The surface temperature of the fixing roller 50 is detected by the temperature detecting device 53. A heating control for the fixing heater 52 is performed by a control device (not shown) based upon a temperature detected by the detecting device 53.

Conventionally, an infrared heater or a halogen heater is adopted as the fixing heater in the fixing device. A roller pair formed by the fixing roller 50 and the pressure roller 51 is a most common structure. However, because the pressure roller 51 is made by forming a silicon layer over a metal core and then coating a mold releasing layer (a tube, etc.) made of fluoride resin over the silicon layer, the thermal capacity of the pressure roller 51 is large. Upon initiation of heating, the pressure roller 51 is not easily warmed up, causing an incomplete fixing. Furthermore, there is also a demerit of high cost assembly parts. In addition, in order to maintain a suitable nip width at the nip portion between the fixing roller 50 and the pressure roller 51, a large pressure (pressing force) is required. This pressure causes a stress against the recording paper which tend to form fixing wrinkles thereon.

In stead of the pressure roller 51, the use of a nip portion for pressing the fixing roller and making a contact with a sheet-shaped unit in a fixing device has been widely studied. The study result showed that by passing the recording paper through the nip portion, an unfixing image is fixed onto the recording paper. The above structure allows easy warm up of the sheet unit because of the sheet-shaped structure, so that the nip width can be maintained, and the thermal efficiency can be further improved compared to the conventional method.

In general, a relationship among the transporting speed V1 of the transfer roller, the transporting speed V2 of the fixing roller and the transporting speed V3 of the ejecting roller satisfies V1>V2 and V3>V2.

The fixing device which uses the pressure roller, the roller itself is able to rotate, and therefore, a gripping force for the recording paper can be easily achieved. Transporting load, resulting from the loop created due to pulling the ejecting roller or the transfer roller for transferring the recording paper quickly, has no influence on the fixing device.

However, when the fixing device adopts the sheet-shaped unit, the sheet-shaped unit offers a resistance for the transporting the recording paper as the sheet-shaped unit is still. The transporting force acquired at the nip portion is very small. As feeding a recording paper where an image is printed on its backside is passed through the fixing device, the toner of the image on the backside is melted and a surface tension is generated on the liquidized toner, as a result wrinkles are formed on the sheet-shaped unit. Therefore, a resistant force against the transportation increases, and a paper jam might occur.

In order to feed the recording paper under various conditions smoothly, it is necessary to transmit the transporting force (provided to the recording paper at the nip portion) more efficiently through the recording paper to the nip portion. In order to transmit the transporting force from the nip portion to the fixing device, it is necessary to prevent the recording paper from being wounded between fixing and transferring stage As for the fixing device adopting the sheet-shaped unit, the transporting load becomes large at an instant when the recording paper enters the nip portion, and therefore, the recording paper might get easily wounded.

If the transporting passage becomes such that the recording paper is wound at the image side, because no recording paper guider is arranged on the image side, the wounding of the paper cannot be prevented and the loop gets expanded, so that the recording paper cannot pass through the nip portion.

SUMMARY OF THE INVENTION

According to the foregoing description, an object of this invention is to provide an image forming device with a fixing device comprising a fixing roller and a sheet-shaped pressure unit, for preventing the poor transportation from occurring between fixing and transferring stage.

According to the object(s) mentioned above, the present invention provides an image forming device, comprising a photoreceptor, a transferring unit, a fixing unit, a sheet-shaped pressure unit, and a guiding unit. The transferring unit is in contact with the photoreceptor for transferring a toner image that is formed on the photoreceptor onto a recording paper, and for transporting the recording paper. The fixing unit comprises a heating source and possesses flexibility. The sheet-shaped pressure unit is in contact with the fixing unit by pressing the fixing unit. When the recording paper where the toner image has been transferred thereon passes a fixing nip portion between the fixing unit and the sheet-shaped pressure unit, the toner image is fixed onto the recording paper by pressing and heating. The guiding unit is used for guiding the recording paper from the transferring unit to the fixing unit. The fixing nip portion is set on an image side of the recording paper, higher than a plane including a transporting direction of the recording paper at a transferring nip portion between the transferring unit and the photoreceptor. In this way, because the front end of the recording paper is moved from the downside to the upside, the recording paper is easily bent on the guiding unit. As a result, the recording paper is transported along the guiding unit, and therefore, the transporting force from the transferring unit is transmitted to the fixing unit, so that the front end of the recording paper can enter and pass through the fixing nip portion due to the transporting force from the transferring unit.

In the above image forming device, one end of the guiding unit near the transferring unit is at a most separated position located at an opposite side of the image side of the recording paper with respect to the plane, and the other end of the guiding unit near the fixing unit is at a most separated position located at the image side of the recording paper with respect to the plane. Furthermore, an inclined surface is formed on the guiding unit from the opposite side of the image side of the recording paper to the image side with respect to the transporting direction of the recording paper. In this way, transport of recording paper on the inclined surface will not get disordered and blocked. Therefore, the recording paper can enter and pass through the fixing nip portion due to the transporting force from the transferring unit.

In addition, the guiding unit is a straight flat shaped structure when viewed from a side. Therefore, there is no hump portion on the image side on the guiding surface of the guiding unit, the loop at the image side on the recording paper can be effectively prevented.

The inclined surface of the guiding surface can be a convex "<" shape on the opposite side of the image side when viewed from a side. By using this structure, there is no hump portion on the image side on the guiding surface of the guiding unit. Additionally, even though the transporting load is imparted on the recording paper, the opposite side of the image side can be easily bent and the recording paper can be moved along the guiding unit Alternatively, the inclined surface of the guiding surface can be a convex curve on the opposite side of the image side in a side-viewing direction. By using this structure, there is no hump portion on the image side on the guiding surface of the guiding unit, and the opposite side of the image side can be easily bent, so that the recording paper can be moved along the guiding unit Moreover, the inclined surface is formed at a position, where a front end of the recording paper that is transported by the transferring unit is initially in contact with the guiding unit. In this way, at the time when the front end of the recording paper is in contact with the inclined surface, the force is imparted on the opposite side of the image side on the recording paper, so that the recording paper can be moved along the guiding unit.

The sheet-shaped pressure unit is disposed in such a way that a step is formed on an installation fitment for the sheet-shaped pressure unit on the guiding unit, and the sheet-shaped pressure unit has an inclination larger than that of the front end of the guiding unit. Therefore, at the time when the front end of the recording paper is in contact with the sheet-shaped pressure unit, the force is imparted on the opposite side of the image side on the recording paper, so that the recording paper can be moved along the sheet-shaped pressure unit.

The sheet-shaped pressure unit can be disposed on the guiding unit such that an entrance direction to the fixing nip portion is the same as the transporting direction of the recording paper on the guiding unit, or is upwards inclined. By using this structure, the front end of the recording paper can be smoothly moved along the sheet-shaped pressure unit to the fixing nip portion.

The image forming device can further comprise an auxiliary guiding unit. The auxiliary guiding unit is disposed near the installation fitment of the sheet-shaped pressure unit on the guiding unit and has a front end located in the vicinity of the fixing nip portion. In this structure, the portion at the stationary end of the sheet-shaped pressure unit is irrelevant to guiding the recording paper, and the recording paper is guided to the fixing nip portion by the auxiliary guiding unit. Therefore, when the sheet-shaped pressure unit is bent, the force for lifting up the recording paper can be prevented from acting on the hump portion on the image side formed at the stationary end of the sheet-shaped pressure unit.

In the image forming device, the photoreceptor is a hard drum and the transferring unit is an elastic roller. Therefore, when the recording paper passes the transferring nip portion, since the elastic roller presses the recording paper against an arc surface of the photoreceptor, the recording paper gets easily bent on the opposite side of the image side during transporting to the fixing nip portion.

The invention further provides a communication device, comprising an image forming device as mentioned above; and an input device, connected to an external terminal, for inputting an image data, wherein an image is recorded onto a recording paper based on the image data input from an external source. In this structure, the time from the beginning of inputting of the image data until the image data is recorded can be reduced. In addition, the transport property can be well maintained.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
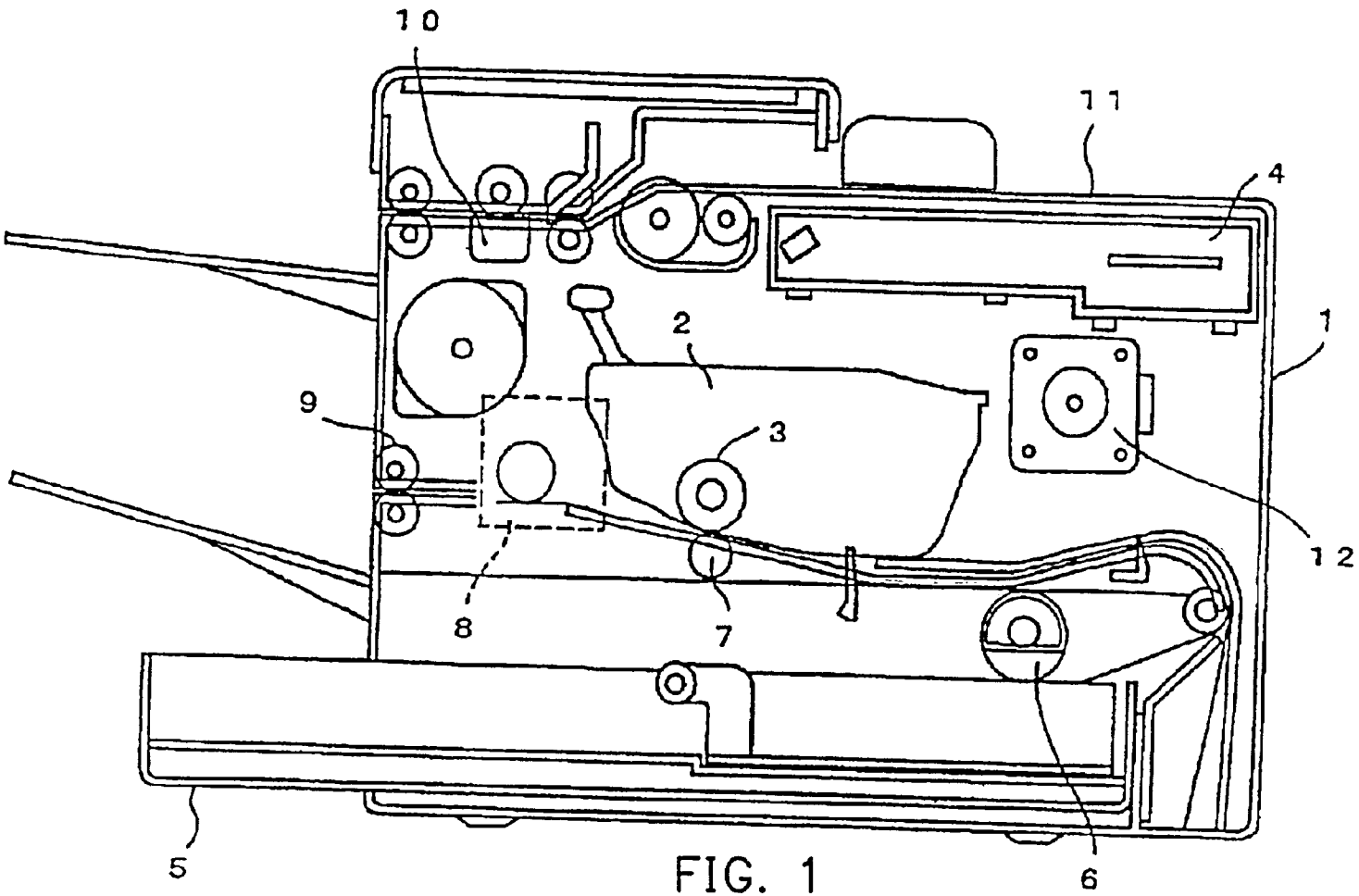
FIG. 1 is a side view showing the internal structure of a facsimile device having a fixing device and an image forming device according to the preferred embodiment of the present invention.

The preferred embodiment of the present invention is described in detail in accordance with the attached drawings. FIG. 1 is a side view showing the internal structure of a facsimile device having a fixing device and an image forming device according to the preferred embodiment of the present invention. The facsimile device's main body 1 comprises a process cartridge 2 that can be detached from the main body 1 and comprises various process units for performing an image formation by an electronic photographic process, a photoreceptor 3 contained within the process cartridge 2, an optical writing device 4 that makes the photoreceptor 3 to scan by a laser beam modulated based upon an image data, a paper-feeding cassette 5 for storing recording papers, a paper-feeding roller 6 for sending out the recording paper from the paper-feeding cassette 5, a transferring roller 7 that is in contact with the photoreceptor 3 for transferring a toner image that is formed on the photoreceptor 3 onto the recording paper, a fixing device 8 for fixing the toner image to the recording paper, a paper-ejecting roller 9, a sealed sensor 10, a document stage 11 formed above the main body 1, and a main motor 12 serving as a driving source of the recording paper transporting system.

Referring to FIG. 1, the photoreceptor 3, the transferring roller 7, the fixing roller 20 (see FIG. 2) and the paper-ejecting roller 9 is constituted to be able to get a driving power from the main motor 12. A transmission mechanism is constructed to transmit rotation from the main motor 12 to the photoreceptor 3, the transferring roller 7, the fixing roller 20 and the paper-ejecting roller 9.

The document placed on the document stage 11 is passed through the sealed sensor 10 by a transport system, and then ejected to external. As the document passes through the sealed sensor 10, the image on the document is optically read by the sealed sensor 10. The image data, which is read by the sealed sensor 10 or input from external, is transmitted to the optical writing device 4. Based on the image data, the optical writing device 4 emits a modulated laser beam to the surface of the uniformly charged photoreceptor 3, so that an electrostatic latent image is formed on the surface of the photoreceptor 3. Then, the toner is made to adhere to the electrostatic latent image to form a toner image, and the toner image is transferred onto the recording paper by the transferring roller 7. When the recording paper transported from the transferring roller 7 passing through the fixing device 8, the toner image on the recording paper is melted by pressing and heating so as to be fixed onto the recording paper. Thereafter, the recording paper is ejected to external through the paper-ejecting roller 9.

Figure 2:
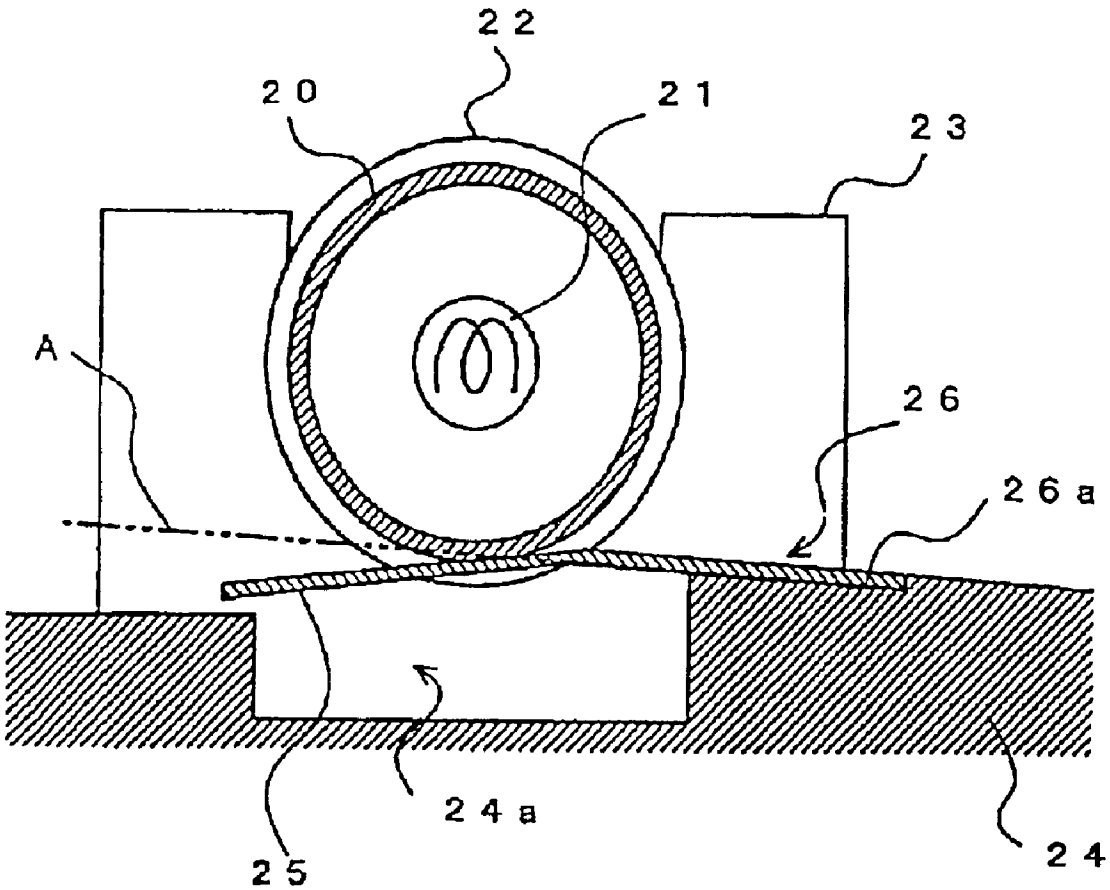
FIG. 2 is a side view showing the structure of the fixing device according to the first embodiment of the present invention.
Figure 3:
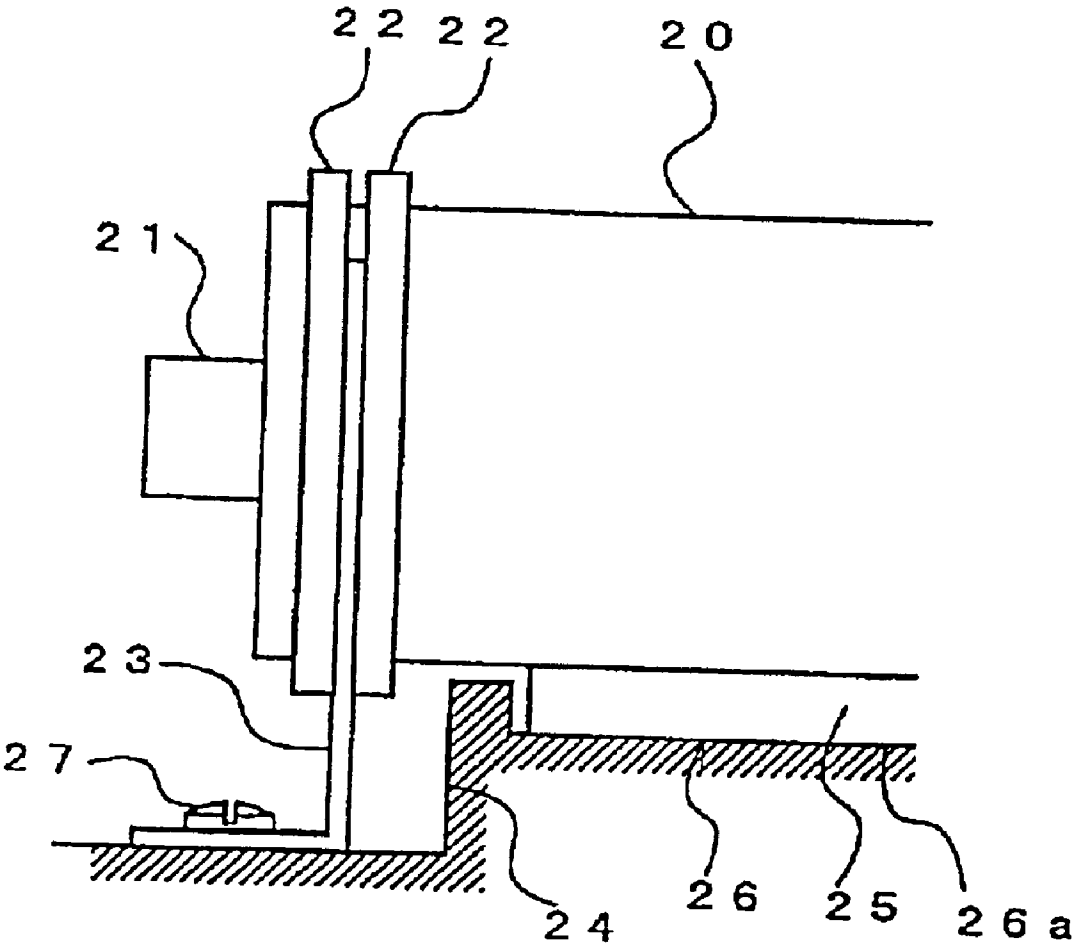
FIG. 3 is a front view of FIG. 2.

FIG. 2 is a side view showing the structure of the fixing device according to the first embodiment of the present invention, and FIG. 3 is a front view of FIG. 2. Referring to FIGS. 2 and 3, the fixing device 8 comprises a fixing roller 20, a heating source 21 for heating the fixing roller 20, bearings 22 formed on the two ends of the fixing roller 20, mounting elements 23 for supporting the bearings 22, a base 24, a sheet-shaped pressure unit 25, an installation fitment 26 of the sheet-shaped pressure unit 23, and screws 27 for screwing the mounting elements 23 to the base 24. In addition, for example, the heating source 21 can be disposed within the fixing roller.

The sheet-shaped pressure unit 25 is formed from a thermo-resistant resin with a resistance against the fixing temperature, such as fluorine resin (PFA, PTFE, or FEP, etc.), or polyimide, etc.

A recess 24*a* is formed in the base 24 at a position opposite to the fixing roller 20. A step-like installation fitment 26 is formed at an edge of the upstream side in the recording paper transporting direction of the recess 24*a*. When the base 24 is formed by molding, a guiding unit for guiding the backside of the recording paper from a transcribing roller 7 to the fixing roller 20, the recess 24*a*, and the installation fitment 26 are also formed at the same time.

The step portion of the installation fitment 26 is in contact with one end of the sheet-shaped pressure unit 25. The sheet-shaped pressure unit 25 is cantilevered-supported on the installation fitment 26, so that one end of the sheet-shaped pressure unit 25 is closely fixed on the installation plane 26*a* by a two-side adhesive tape, and the other end of the sheet-shaped pressure unit 25 is a free end and is capable of moving upwards and downwards.

The fitting elements 23 are secured to the base 24 by using screws 27 in the downstream side of the recording paper transporting direction with respect to the installation fitment 26. As shown in FIG. 2, by supporting the fitting element 23 in between the bearings 22 of the fixing roller 20, the fixing roller 20 can be mounted within a main body of an image forming device (FIG. 1). The installation fitment 26 is formed on the base 24, so that a plane containing the installation plane 26*a* crosses under the fixing roller 20. By closely affixing the sheet-shaped pressure unit 25 to the installation fitment 26, the sheet-shaped pressing unit 25 is cantilever-supported along the plane A containing the installation plane 26*a* In this embodiment, the installation plane 26*a* is formed in such a manner that the sheet-shaped pressure unit 25 is inclined upwards.

Therefore, when mounting the fixing roller 20, the fixing roller 20 is in contact with and presses against the sheet-shaped pressure unit 25, so that the fixing roller 20 and the sheet-shaped pressure unit 25 touch each other under a pressure. A pressure is applied by the sheet-shaped pressure unit 25 onto the fixing roller 20, which is comparable to a nip pressure. The elasticity of the sheet varies depending upon the thickness and/or the material of the sheet-shaped pressure unit 25, accordingly, the fitting position of the fixing roller can be set to meet a desired nip pressure for achieving desired features of the sheet-shaped pressure unit 25. In addition, when mounting the fixing roller 20, the free end of the sheet-shaped pressure unit 25 can be near or in contact with the step portion of the recess 24*a* in the recording paper transporting direction with respect to the nip portion.

Figure 4:
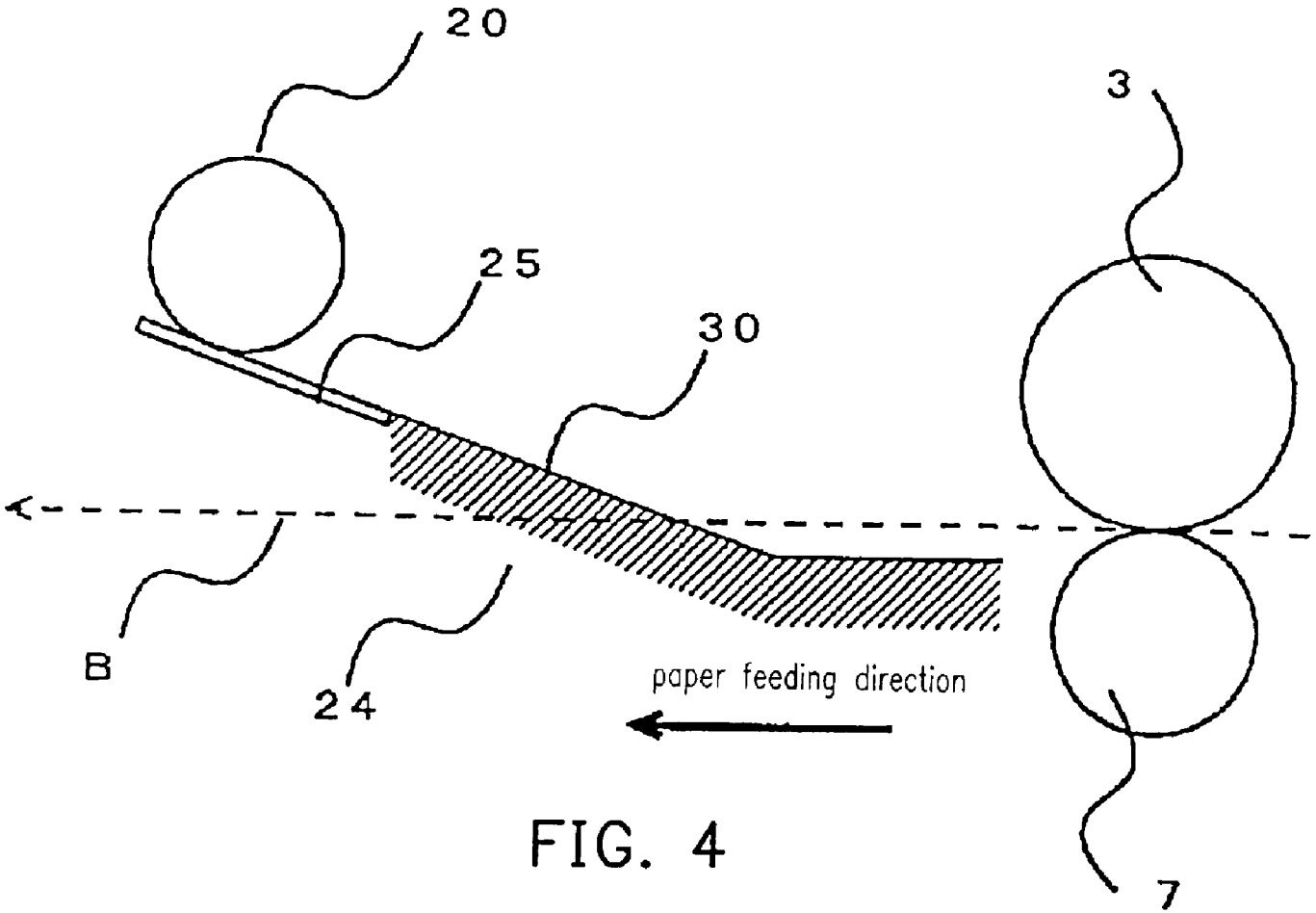
FIG. 4 is a side view showing the structure of the fixing device and its peripherals.

FIG. 4 is a side view showing the structure of the fixing device and its peripherals. In FIG. 4, a recording paper guider 30 is depicted The recording paper guider 30 is disposed from the transferring roller 7 to the installation fitment 26 over the base 24 (also referring to FIG. 2). The guiding surface of the recording paper guider 30 is upwards inclined from a lowest position near the transferring roller 7 to the fixing roller 20. At this time, the position of a nip formed between the fixing roller 20 and the sheet-shaped pressure unit 25 is located above the plane B that starts from a transfer nip portion formed between the photoreceptor 3 and the transferring roller 7 and then extends substantially along a recording paper transporting direction at the transfer nip portion.

The recording paper where the toner image has been transferred from the photoreceptor 3 is transported due to the rotations of the photoreceptor 3 and the transferring roller 7. The front end of the recording paper is in contact with the inclined surface of the recording paper guider 30 at the beginning, and then sent to the fixing nip portion between the fixing roller 20 and the sheet-shaped pressure unit 25 due to the recording paper being moved along the incline surface. When the recording paper enters the fixing nip portion, a transporting load will act on the recording paper, and thereafore, the transporting speed for the recording paper is not stable. On the other hand, because the transferring roller 7 rotates stably, the recording paper gets easily bent.

Figure 5A:
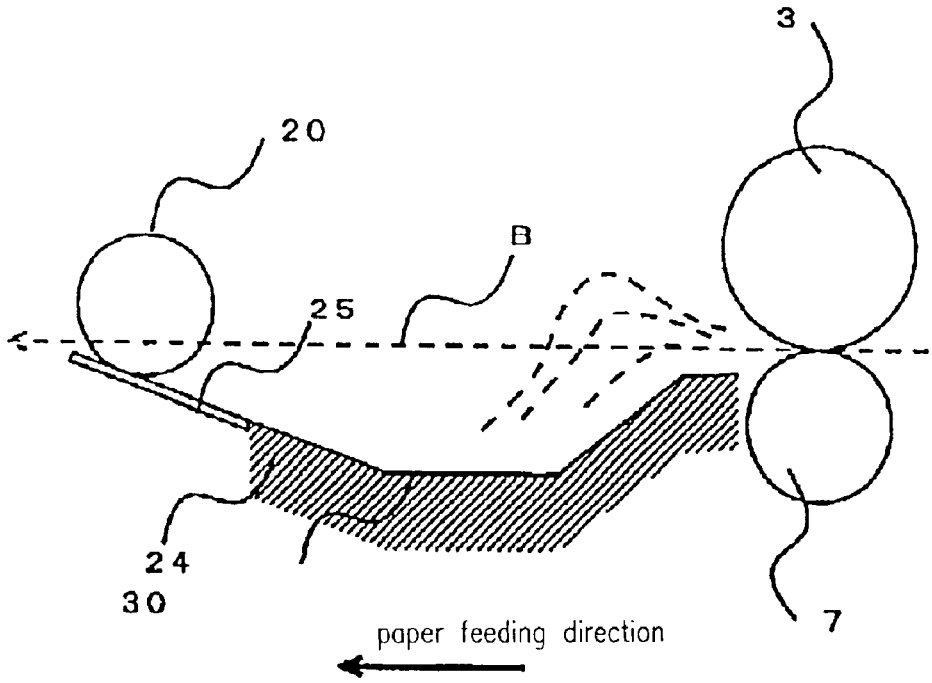
FIGS. 5A and 5B show situations that there occurs humps on the image formed side between the transferring and the fixing.
Figure 5B:
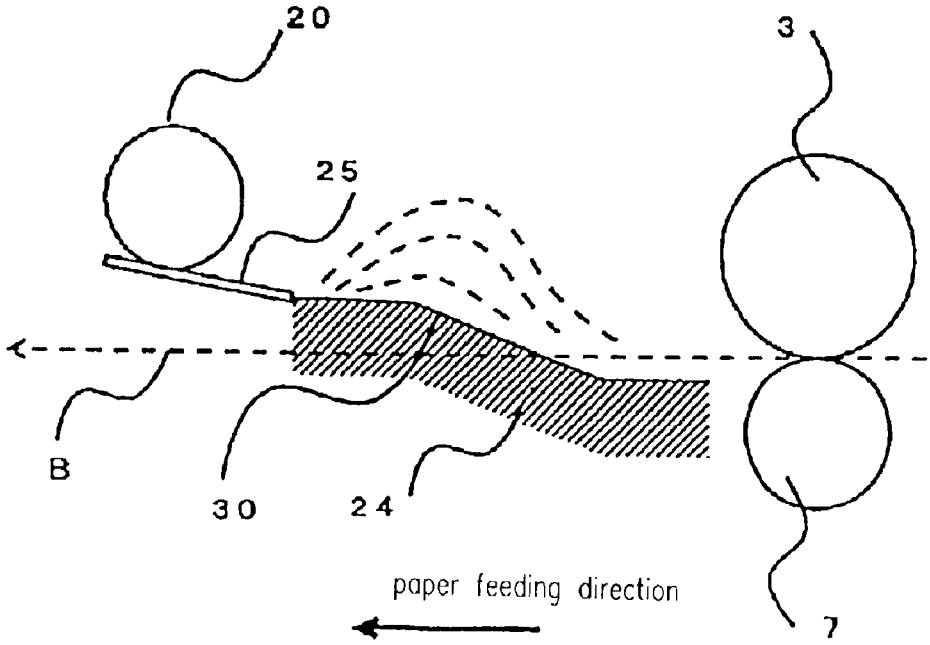

FIGS. 5A and 5B show where humps occur on the image side between the transferring and the fixing stage. FIG. 5A shows that the recording paper guider 30 is formed in a concave shape. In this situation, the recording paper transported by the transferring roller 7 is moved downwards once, then raised by the inclined surface and then sent to the fixing nip portion. FIG. 5B shows that the two ends of the recording paper guider 30 are plane and the central portion is raised from the guider 30 surface (upwards inclined). In FIG. 5A, the portion moving from the plane to the downwards inclined surface is humped on the image side of the recording paper. In FIG. 5B, the portion moving from the upwards inclined surface to the plane is humped on the image side of the recording paper. If the transporting load when the recording paper enters the fixing nip portion is added, the portion where the recording paper is located at the hump portion on the image side gets bent to the image side. Afterwards, if the recording paper does not stably pass through the fixing nip portion, the bending grows and the paper jam occurs.

However, according to this embodiment, as shown in FIG. 4, the surface of the recording paper guider 30 is inclined and gradually raised. After the recording paper gets in contact with inclined surface, the opposite side is bent and the recording paper is in contact with the surface of the recording paper guider 30, and therefore, the recording paper is guided to transport along the recording paper guider 30. Then, by passing the recording paper through the fixing nip portion, the toner image is fixed on the recording paper. Furthermore, because no hump portion is created on the image side between the transferring and the fixing stage on the surface of the recording paper guider 30, the loop created on the image side of the recording paper can be reduced.

According to the aforementioned structure, the recording paper is bent on the image side (where the image is formed thereon) between the transferring and the fixing stage, the transporting force of the transferring roller is not transmitted to the fixing device, and therefore the occurrence of the paper jam can be effectively prevented. The transporting force for passing the nip portion can be stabilized and this transport force is supplied from the transferring roller 7.

Figure 6:
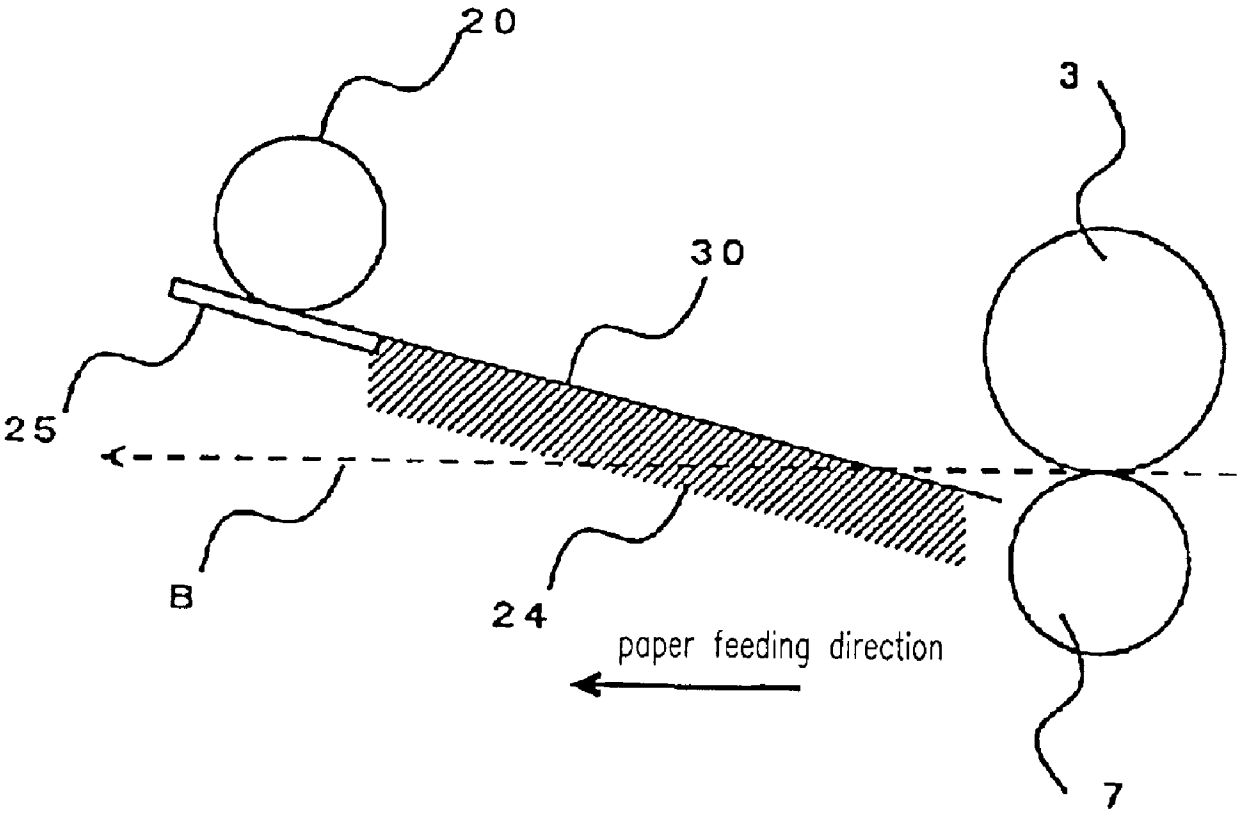
FIG. 6 is a side view showing the fixing device and its peripheral structure.
Figure 7:
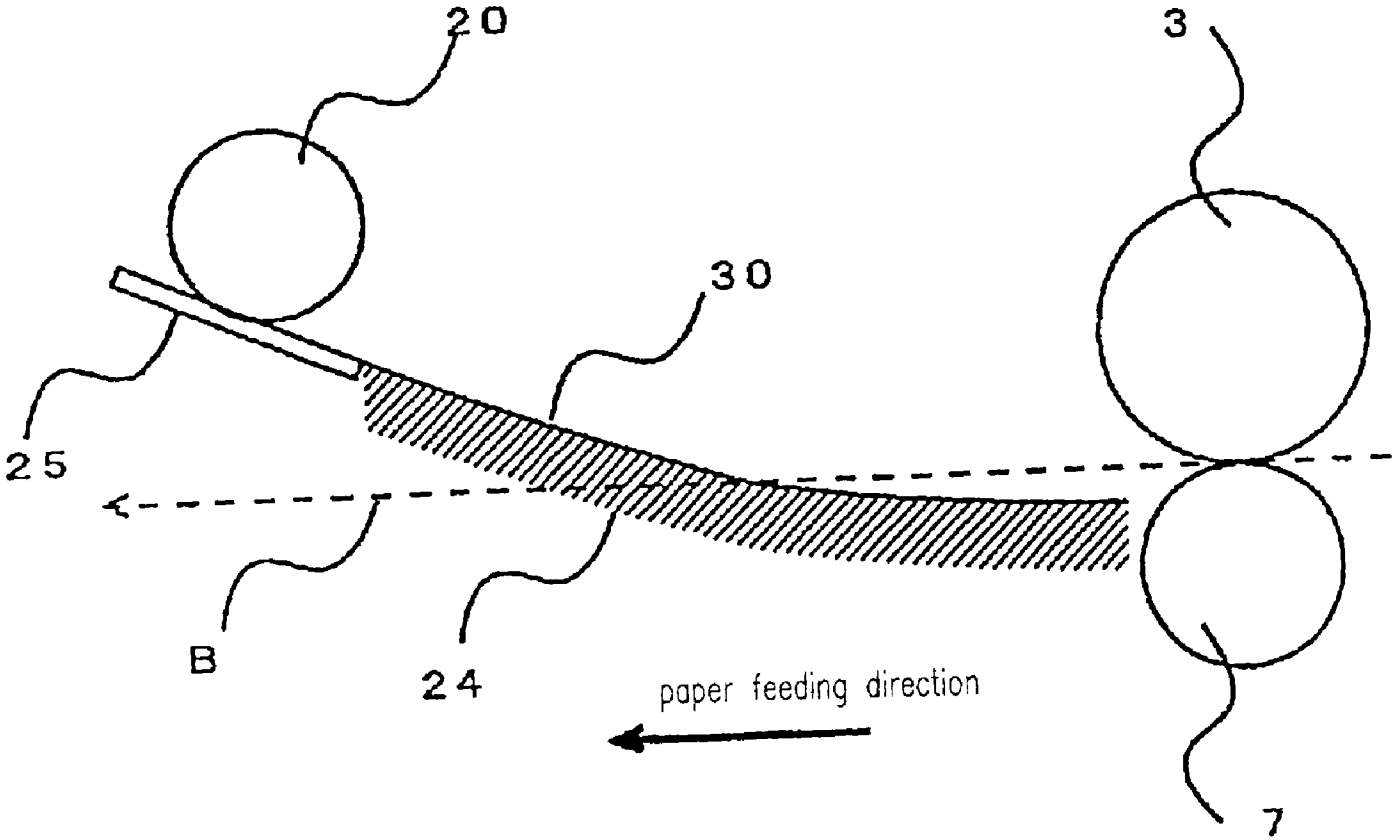
FIG. 7 is a side view showing the fixing device and its peripheral structure.

In FIG. 4, the guiding surface of the recording paper guider 30 is substantially a "<" shape, but can be a straight flat shape as shown in FIG. 6 or a curve shape as shown in FIG. 7. In addition, when the entrance angle to the nip portion at the sheet-shaped pressure unit 25 is smaller than the angle of the transporting direction of the front end of the recording paper guider 30, since the sheet-shaped pressure unit 25 near the installation fitment 26 is humped to the image side, the direction of the sheet-shaped pressure unit 25 is same as the transporting direction at the front end of the recording paper guider 30, or larger than an angle with respect to the transporting direction.

When the flexibility of the sheet-shaped pressure unit 25 is large, the sheet-shaped pressure unit 25 is bent downward due to the pressure of the pressing force of the fixing roller 20, as a result several humps are formed near the installation fitment 26 at the sheet-shaped pressure unit 25, thus the bending of the recording paper on the image side at the hump portion becomes possible. In view of the above concerns, the second embodiment of the invention is described as follows.

Figure 8:
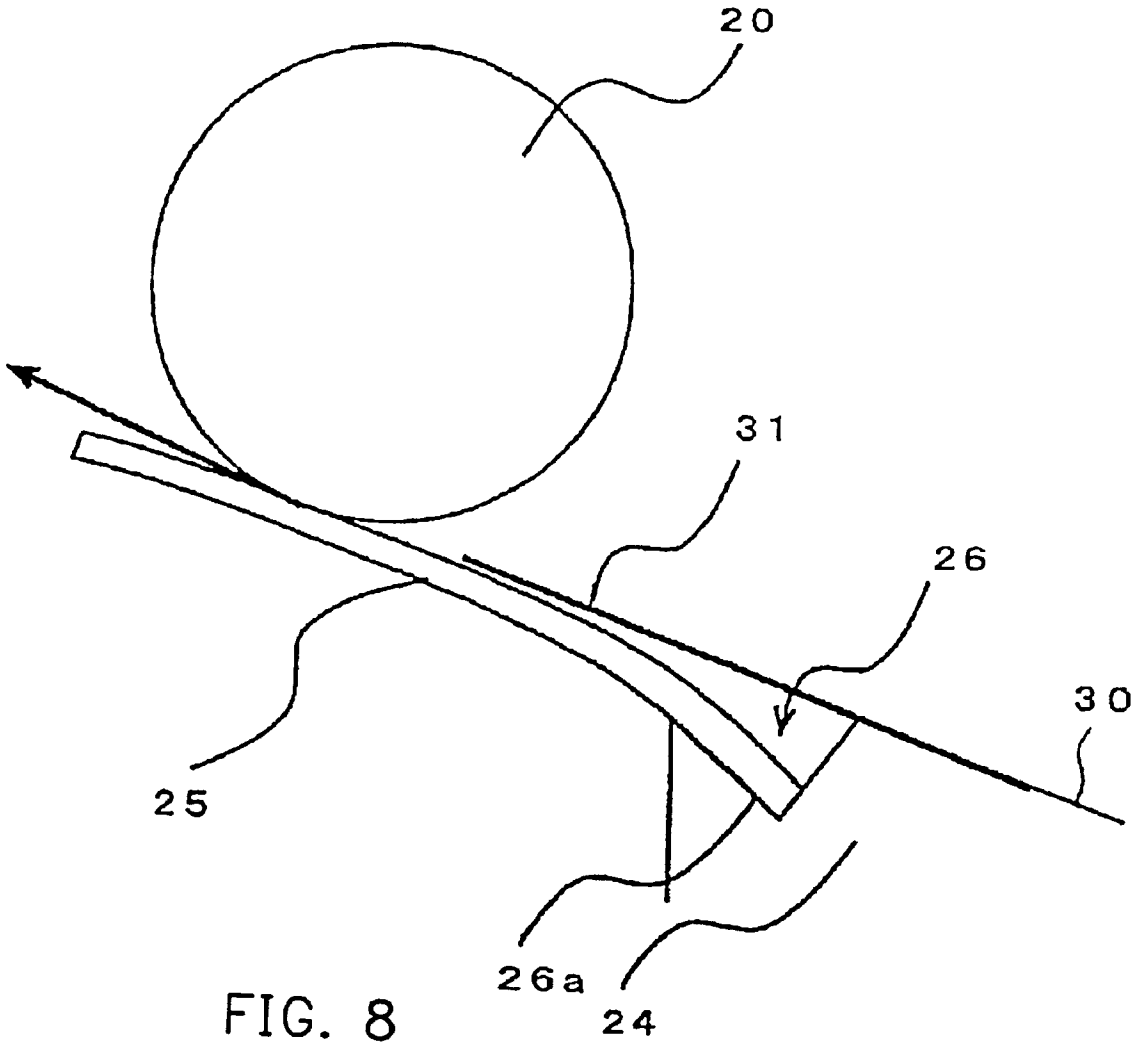
FIG. 8 shows a structure of the main elements according to the second embodiment of the present invention.
Figure 9:
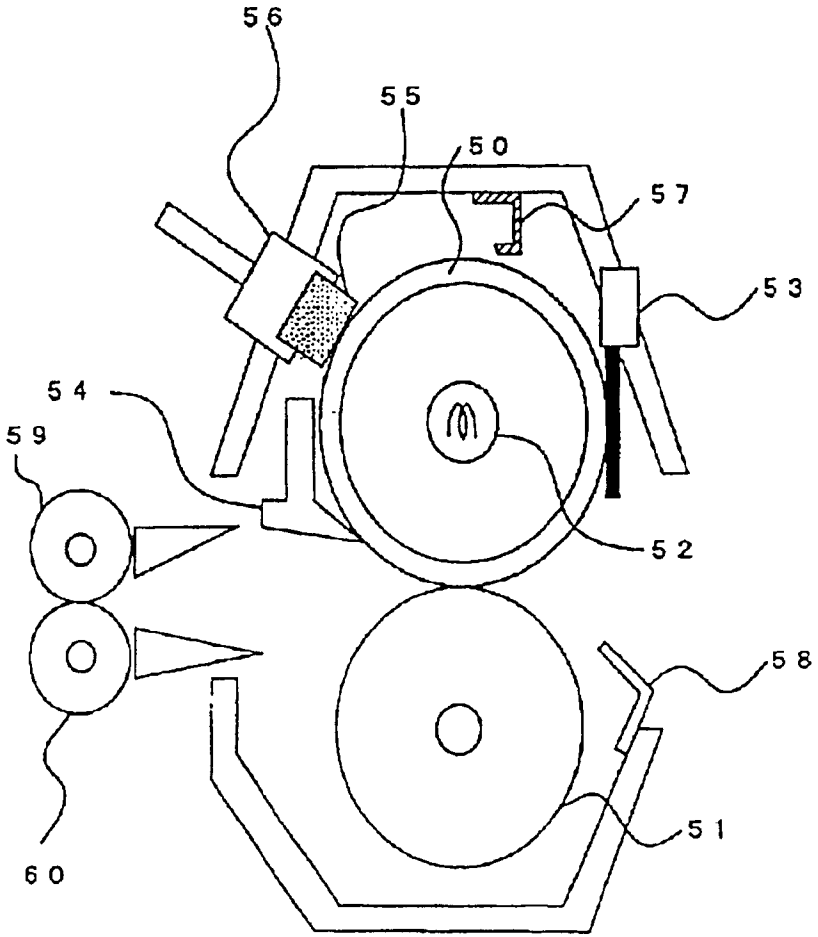
FIG. 9 (PRIOR ART)
FIG. 9 is a side view showing an internal structure of a conventional fixing device.

FIG. 8 shows a structure of the main elements according to the second embodiment of the present invention. In FIG. 8, a sheet-shaped auxiliary guiding plate 31 is depicted. In addition, the elements in the first embodiment shown in FIGS. 2 to 4 and the element of the same or having the same function are labeled with the same numbers, and their descriptions are omitted.

One end of the auxiliary guiding plate 31 is fixed to the front end of the recording paper guider 30, and the other end is located near the nip portion. In addition, the inclination angle of the installation plane 26*a* is set larger than that of the surface of the recording paper guider 30. The sheet-shaped pressure unit 25 is fitted to the installation fitment 26. When installing the fixing roller 20, the sheet-shaped pressure unit 25 is bent. At this time, the tangential direction at the contact point between the fixing roller 20 and the sheet-shaped pressure unit 25 is the same as the transporting direction at the front end of the recording paper guider 30, or the tangent angle is set larger.

The recording paper when guided along the recording paper guider 30 is guided by the auxiliary guiding plate 31 from the front end of the recording paper guider 30, and then sent to in the vicinity of the fixing nip portion. Thereafter, the recording paper enters the nip portion, and the recording paper is pressed and heated According to the structure as described above, because the recording paper does not pass directly the hump portion on the image side created by the sheet-shaped pressure unit 25 without being bent, therefore the occurrence of loop resulting from the hump can be prevented. Additionally, the recording paper can enter and stably pass through the nip portion due to a transporting force supplied by the transferring roller 7.

Although the embodiments of the present invention are described above, the inventive scope is not limited to the aforementioned embodiments. For example, the transferring roller can be made of an elastic material. When the recording paper passes through the transferring nip portion, the recording paper is pressed against the drum-shaped photoreceptor. In this way, the recording paper can be easily bent downward when the recording paper is transported to the fixing nip portion.

The embodiment uses a facsimile device as an example to describe, but does not limit its use in the facsimile device. For example, the embodiment of the invention is also suitable for a printer, a copy machine, or a multi-function machine possessing the above functions. In particular, for a machine where the image data is input from an external terminal (such as the facsimile or the printer) through the telephone line or the cable, etc., and then the image (image data) is recorded onto the recording paper, because the fixing device can be ready quickly or stand by, for a time from the image data being input to until the image data being recorded can be reduced, and additionally, the recording paper can be stably transported during the above processes.

In addition, the embodiment describes an exemplary machine that the recording paper is transported in a substantially horizontal direction with respect to the vertical direction. However, the transporting direction of the recording paper does not limit to the horizontal direction. For example, the invention can be also suitable for a machine where the recording paper is transported in the vertical direction. If the fixing nip portion is positioned on the image side with respect to the transporting direction due to the rotation of the transferring roller, the locations of the transferring roller 7 and the fixing roller 20 are not limited.

As described above, according to the structure of the present invention, when the recording paper enters the fixing nip portion, even though the transporting load is imparted on the recording paper, the image side of the recording paper can be prevented from being curled because the recording paper moves along the guiding surface of the recording paper guider. As a result, the recording paper can be entered and passed through the fixing nip portion by the transporting force of the transferring roller.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. An image forming device, comprising:

a photoreceptor;

a transferring unit disposed opposite to the photoreceptor, the photoreceptor and transferring unit forming a transferring nip portion;

a fixing unit;

a sheet-shaped pressure unit disposed opposite to the fixing unit, the fixing unit and the sheet-shaped pressure unit forming a fixing nip portion; and a guiding unit having a flat surface adjacent the sheet-shaped pressure unit, the flat surface configured to guide a recording paper from the transferring nip portion to the fixing nip portion, wherein the pressure unit overhangs a recess defined in the guiding unit such that the pressure unit is permitted to move into and out of the recess unimpeded.

2. The image forming device of claim 1, wherein the guiding unit comprises a first portion adjacent the transferring nip portion and a second inclined portion adjacent the fixing nip portion.

3. The image forming device of claim 2, wherein the guiding unit comprises flat top and bottom surfaces.

4. The image forming device of claim 2, wherein the second inclined portion comprises a convex shape.

5. The image forming device of claim 2, wherein the second inclined portion comprises a convex curve.

6. The image forming device of claim 2, wherein the second inclined portion is configured to receive an end of the recording paper ejected from the transferring nip portion.

7. The image forming device of claim 1, further comprising:

an auxiliary guiding unit disposed near an installation fitment for the sheet-shaped pressure unit on the guiding unit and having a front end located in vicinity of the fixing nip portion

8. The image forming device of claim 1, wherein the photoreceptor comprises a drum and the transferring unit comprises an elastic roller.

9. A communication device, comprising:

the image forming device of any one of claims 1–8; and an input device configured to receive an image data, wherein the image forming device is configured to record an image on the recording paper based on the image data.

10. The image forming device of claim 1, wherein the fixing nip portion is separated from a plane, the plane including a transporting direction of the recording paper at the transferring nip portion, on an image side of the recording paper.

11. The image forming device of claim 10, wherein the fixing nip portion is disposed at a relatively higher elevation than the transferring nip portion.

12. An image forming device, comprising:

a photoreceptor;

a transferring unit disposed opposite to the photoreceptor, the photoreceptor and transferring unit forming a transferring nip portion;

a fixing unit;

a sheet-shaped pressure unit disposed opposite to the fixing unit, the fixing unit and the sheet-shaped pressure unit forming a fixing nip portion; and a guiding unit having a flat surface adjacent the sheet-shaped pressure unit, the flat surface configured to guide a recording paper from the transferring nip portion to the fixing nip portion, wherein the sheet-shaped pressure unit is disposed such that a step is formed on an installation fitment for the sheet-shaped pressure unit on the guiding unit, and the sheet-shaped pressure unit has an inclination larger than that of the front end of the guiding unit.

13. An image forming device, comprising:

a photoreceptor;

a transferring unit disposed opposite to the photoreceptor, the photoreceptor and transferring unit forming a transferring nip portion;

a fixing unit;

a sheet-shaped pressure unit disposed opposite to the fixing unit, the fixing unit and the sheet-shaped pressure unit forming a fixing nip portion; and a guiding unit having a flat surface adjacent the sheet-shaped pressure unit, the flat surface configured to guide a recording paper from the transferring nip portion to the fixing nip portion, wherein the sheet-shaped pressure unit is disposed on the guiding unit such that an entrance direction to the fixing nip portion is the same as the transporting direction of the recording paper on the guiding unit, or is inclined upwardly.

* * * * *